US005620186A

United States Patent [19]

Dudley

[11] Patent Number: 5,620,186

[45] Date of Patent: Apr. 15, 1997

[54] SOCCER TRAINING AND PRACTICE DEVICE

[76] Inventor: Primo P. Dudley, 1352 Maryland Dr., Concord, Calif. 94521

[21] Appl. No.: 697,082

[22] Filed: Aug. 19, 1996

[51] Int. Cl.[6] ..... A63B 69/00

[52] U.S. Cl. ..... 473/423

[58] Field of Search ..... 273/413, 414, 273/411, 58 C

[56] References Cited

U.S. PATENT DOCUMENTS

| | | | |
|---|---|---|---|
| 3,351,343 | 11/1967 | Papp | 273/26 E |
| 4,147,353 | 4/1979 | Moore | 273/413 |
| 4,278,257 | 7/1981 | Garcia et al. | 273/413 X |
| 4,307,888 | 12/1981 | Ohle | 273/413 |
| 4,592,549 | 6/1986 | Ryan | 273/413 X |

*Primary Examiner*—William H. Grieb

[57] ABSTRACT

A soccer training device is described, for holding and retreiving an adjustable soccer ball holder, which fits a size 4 and 5 soccer ball. The bungee cord is anchored by a tent stake. The bungee cord is adjustable at the stake, from variable lengths approximately 1–20 feet by wrapping the cord around the stake.

The adjustable soccer ball holder has two, 2-inch wide continuous straps of webbing that cross at right angels and are sewn to the top and bottom, to form 4 equal length elongated peices of webbing.

The mid-point of the casing has a center strap of material representing the middle of the soccer ball holder. The center strap of material has a first and second end. The first end has a male Velcro closure while the socond end has a female closure. The center strap is sewn to four outer straps of webbing. The space between each strap is sewn in approximately 4 ¼ inch spacings. The soccer ball enters and exits the soccer ball holder from the Velcro closure.

The present invention can be used by one person or in team practice session. This invention allows a player, or players to practice several different soccer training exercises to improve skill and technique.

1 Claim, 2 Drawing Sheets

Fig. 10

SOCCER TRAINING AND PRACTICE DEVICE

FIELD OF THE INVENTION

This invention relates to a soccer training device for holding and retrieving a soccer ball.

BACKGROUND OF THE INVENTION

Proficient play of the game of soccer requires certain skills on the part of each player. They include, goal kicking, passing, headers, punting, goalie defense and throwing.

While all these training exercises are clearly useful, there are several well-known drawbacks associated with them. A prime problem is goal kicking. If a kicked soccer ball is not trapped by a goal net, it must be retrieved in order to be available for use again. For this reason, traditionally multiple soccer balls must be purchased for practice.

Another drawback to soccer practice is that many drills require more than one person, and cannot be performed alone. Clearly there is a need for a soccer training device that can be used by an individual, as well as in a team practice session. Such a device would allow each player to practice the skills and techniques he or she is learning to master.

SUMMARY OF THE INVENTION

The present invention is a soccer training device that effectively holds and retrieves a soccer ball. The training device allows a player to tailor the device to their needs. The adjustable bungee cord allows a player of different skill levels to adjust it to their skill level as well as different sized playing areas. The adjustable ball holder fits a size 4 and 5 soccer balls.

The soccer training device provides many advantages over existing training methods. The present invention can be used in many different ways to build various skills. For example, kicking goals, dribbling, throwing, passing, punting, catching and headers.

The present invention covers all the major soccer training exercises, and can be used by an individual or in a team practice session. Other features and advantages of the present invention will become apparent from the following more detailed description. The accompanying drawings illustrate, by way of example, the principles of the invention.

DESCRIPTION OF THE PREFERRED EMBODIMENTS

Figure 1:
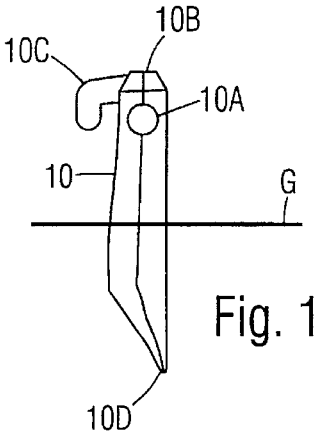
FIG. 1 A perspective illustration of one anchor which is partially driven into the ground, thus anchoring the invention, FIG. 2 A perspective view of an elongated bungee.

Referring to the drawing:

FIG. 1 shows a plastic 9-inch tent stake indicated by the numeral 10. Numeral **10*b* shows the top of the tent stake which has a flat surface for hammering or pushing the stake into the ground. The hole in the tent stake, numeral 10*a* shows how the bungee cord is tied to the stake. The extended hook, 10*c* is used to help secure the adjustments of the bungee cord, numeral 10*d* the bottom of the tent stake which has a pointed end for entering the ground. The stake is made from ABS resins, rust proof, light weight and no sharp edges. The stake numeral 10**, is partially driven into the ground indicated by the letter g.

Figure 2:
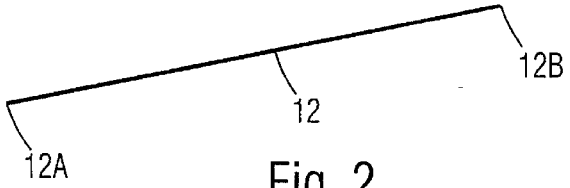

FIG. 2 shows an elongated bungee cord size 7/64 by 20 feet in length shown by numeral 12. The bungree cord has a first end **12*a* which is tied to the tent stake, numeral 10. The second end of the cord 12*b* is tied to the nylon loop numeral 22**.

Figure 3:
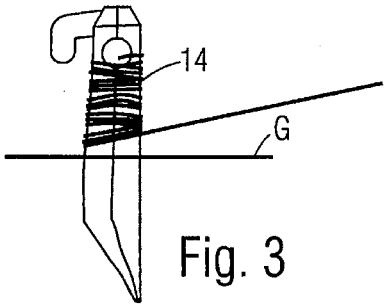
FIG. 3 A perspective of an adjustable bungee cord from variable lengths 1–20 feet, by wrapping the cord around the stake.

FIG. 3 shows a bungee cord indicated by numeral 12 adjustable from variable lengths 1–20 feet by wrapping the cord around the stake indicated by numeral 14.

Figure 4:
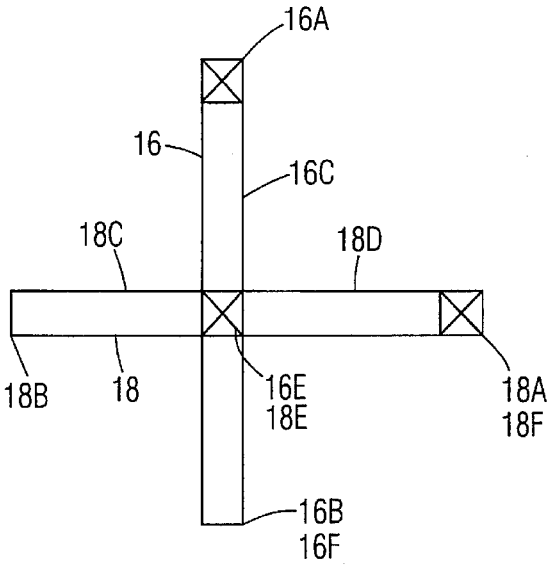
FIG. 4 A perspective view of two continuous straps of material that cross at right angles. The two continuous twill elastic straps have a top, middle, and bottom.

FIG. 4 shows the soccer ball casing is formed of 67% polyester, twill elastic, and 33% rubber providing inherent strength, durability, and flexibility. The soccer ball holder provides fexlibility for fiting a size 4, and 5 soccer ball. The soccer ball holder shows numeral 16, an elongated strap of twill elastic made into a circle. The ends of the continuous circle include a 2-inch overlap. The first end, numeral **16*b* is on the bottom while the second end, numeral 16*a* is on top, both are centered and sewn square. The soccer ball holder indicated by numeral 18 elongated strap of twill elastic is formed into a circle. The ends of the continuous circle include a 2-inch overlap centered, sewn, and squared. The first end, numeral 18*b* is on the bottom and the 2-inch overlap section, numeral 18*a* is shown as a the top of the overlap. The two elongated straps shown in numerals 16 and 18 cross at right angles. On top of the casing, numerals 16*f* and 18*f*, as well as the bottom 16*e* and 18*e* are centered and sewn square. The mid section of numerals 16 and 18 shows four straps equally spaced indicated by numerals 16*c*, 16*d*, 18*c* and 18*d***.

Figure 5:
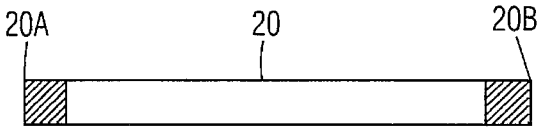
FIG. 5 A perspective view of elongated center strip of material located in the mid-point of the soccer ball holder-.The closure includes male and female velcro attachments. The center strap is sewn to four outer straps of webbing in equal spacings.

FIG. 5 shows an elongated center strap of material located in the middle of the soccer ball holder shown by numeral 20. The middle strap is sewn to four outer straps of webbing of equal spacing indicated by numerals **16*c*, 16*d*, 18*c* and 18*d*. The ends of the middle strap have a male and female velcro closure shown as numerals 20*a* and 20*b*. The velcro closure shown numeral 20*b*, the male end of the velcro closure, on top and numeral 20*a***, the female end, on the bottom. The soccer ball enters and exits the soccer ball holder from the velcro closure.

Figure 6:
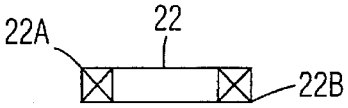
FIG. 6 A perspective view of nylon loop. The loop is sewn to the top of the soccer ball casing.

FIG. 6 shows the nylon loop indicated by numeral 20, 3 ⅛ inches in length, 1 inch wide, and is sewn to the top of the soccer ball holder. The nylon loop is bent a ¼ inch on each end to form a loop. The first end is bent left ¼ inch indicated by numberal 22*a* and sewn to numerals 16*f* and 18*f*. The second end, numeral 22*b* is bent right ¼ inch and sewn to numrals 16*f* and 18*f*.

Figure 7:
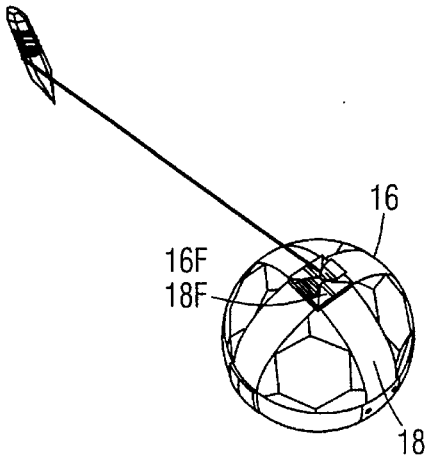
FIG. 7 A perspective view showing the top veiw of the soccer ball holder.

FIG. 7 shows the top sectional view of the soccer ball enclosed in the soccer ball holder. The two continuous straps of eleastic shown by numerals 16 and 18 crossing at right angles. The nylon loop indicated by numeral 22 is located under numerals 16*f* and 18*f*.

Figure 8:
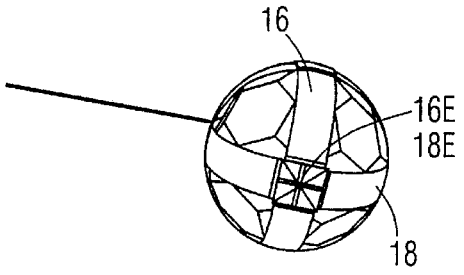
FIG. 8 A perspective view of the bottom of the soccer ball holder.

FIG. 8 shows the bottom section view, two continuous straps, numerals 16*e* and 18*e* corss at right angles and are sewn square.

Figure 9:
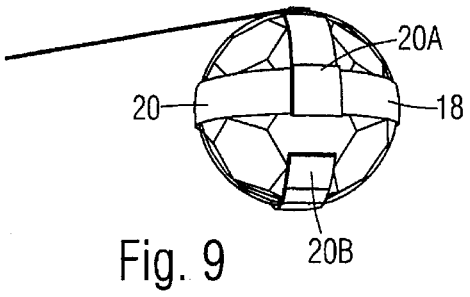
FIG. 9 A left side view of the soccer ball holder. Showing the male and female velcro attachments.

FIG. 9 shows the side sectional view, the center shows numeral 20 the middle of the soccer ball holder. The female velcro closure indicated by numeral 20*a* and the male velcro closure numeral 20*b* are shown open with the soccer ball enclosed. The numeral 18 shows a continuous elastic strap crossing the middle strap indicated by numeral 20.

Figure 10:
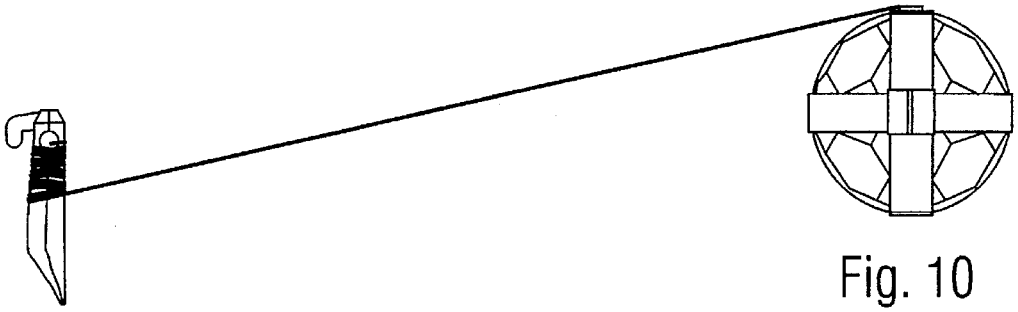
FIG. 10 showing the entire assembly of components of the invention.

FIG. 10 shows the entire assembly view for holding and retrieving a soccer ball. The elements include: a nylon loop indicated by numeral 22, two continuous elongated twill eastic straps numerals 16 and 18 that cross at right angles. Numerals 16 and 18 also show four middle straps equally spaced indicated by numerals 16*c*, 16*d*, 18*c* and 18*d*. Numerals 16*a* and 18*a* show a 2-inch overlap centered, sewn square. Numerals 16*f* and 18*f* represent the top section of numerals 16 and 18. Numerals 16*e* and 18*e* represent the bottom section of numerals 16 and 18. Numeral 20 shows the middle elongated strap that shows each strap. Numerals 16*c*, 16*d*, 18*c*, and 18*d* centered, sewn and squared in equal spacings, the middle elongated strap shows numeral 20*b* as male velcro closure and numeral 20*a* as the female velcro cosure located on the bottom. Numeral 10 shows a tent stake as an anchor. Numeral 10*b* shows a flat surface. Numeral 10*c* shows an extended hook for adjustment of a bungee cord. Numeral 10*a* shows a hole for tying the bungee cord to the stake. Numeral 10*d* shows the bottom of the tent stake which has a pointed end for entering the ground. Numeral 12 shows an elongated bungee cord with the first end , numeral 12*a*, tied to numeral 10*a*, and the second end, numeral 12*b* tied to numeral 22. Numeral 14 shows variable lengths of adjustment, 1–20 feet by wrapping numeral 12, the bungee cord around the stake, numeral 10.

I claim:

1. An apparatus for holding and retrieving a soccer ball comprising:

(a) an anchor means;

(b) an elongated bungee cord member having a first end and second end;

(c) an said elongated bungee cord adjustable from variable lengths approximately 1–20 feet by wrapping the said cord around the anchor;

(d) An adjustable soccer ball casing for holding said soccer ball, said soccer ball holder including two continuous straps of webbing that cross at right angles and are sewn at the top and bottom to form 4 equal length elongated peices of webbing, the said soccer ball holder fits a size 4 and 5 soccer ball;

(e) an elongated center strap of twill elastic belting material, represents the middle of the soccer ball holder, which has a first and second end, the said first end has a male velcro closure while the said second end has a female velcro closure, the said center strap is sewn to four outer straps of webbing, the space between each strap is sewn approximately 4 ¼ inch spacings, the said soccer ball enters and exits from the said velcro closures;

(f) a nylon loop is affixed to the top of the said soccer ball holder, the loop is 1 inch in width, approximately 3 ⅛ in length, having a first end and second end, the first and second ends are bent a ¼ inch inward and sewn to form a loop.

* * * * *